United States Patent [19]

Fischer

[11] 4,045,256

[45] Aug. 30, 1977

[54] CHROME STEEL CASTING ALLOY

[75] Inventor: Robert B. Fischer, Easton, Pa.

[73] Assignee: Ingersoll-Rand Company, Woodcliff Lake, N.J.

[21] Appl. No.: 694,348

[22] Filed: June 9, 1976

Related U.S. Application Data

[63] Continuation of Ser. No. 555,598, March 5, 1975, abandoned.

[51] Int. Cl.[2] ..... C22C 38/44

[52] U.S. Cl. ..... 148/36; 75/128 W; 148/37

[58] Field of Search ..... 148/36, 37; 75/128 R, 75/128 W

[56] References Cited

U.S. PATENT DOCUMENTS

| | | | |
|---|---|---|---|
| 2,388,128 | 10/1945 | Eckel | 75/128 R |
| 2,999,039 | 9/1961 | Lula et al. | 148/37 |
| 3,663,208 | 8/1972 | Kirby et al. | 75/128 W |

*Primary Examiner*—Arthur J. Steiner
*Attorney, Agent, or Firm*—Walter C. Vliet

[57] ABSTRACT

A low carbon Martensite structure is obtained in a low chrome-nickel casting steel consisting of less than 0.06 percent C, 4.75 to 5.75 percent Cr, 2.75 to 3.50 percent Ni, 0.45 to 0.65 percent Mo, less than 1.0 percent each of Mn and Si, and less than 0.04 percent of each P and S with the remainder essentially Fe. The resulting material has excellent weldability and handling characteristics without preheat. It is superior in this regard to the present ASTM A217 Gr 56 alloy which it is intended to replace.

1 Claim, No Drawings

CHROME STEEL CASTING ALLOY

This is a continuation, of application Ser. No. 555,598 filed Mar. 5, 1975, now abandoned.

BACKGROUND OF THE INVENTION

Specification ASTM A 217 Gr. C5 provides a low chrome casting steel widely utilized in the industry for casting relatively large parts such as pimp casings. One of the major shortcomings of this material is the fact that it requires preheat to prevent cracking when performing operations such as cutting of gates and risers and welding.

It is the object therefor of this invention to teach a modified low chrome casting alloy having mechanical properties essentially equal to or superior to that of ASTM A 217 Gr. C5that does not require preheat for performing operations such as mentioned above.

It is further the object of this invention to provide a casting alloy that is less costly and troublesome to produce through the final stages of production flow through the foundry and machine shop.

Generally the object of this invention is to teach a low chrome casting alloy which is produced in the same manner as the material of ASTM A 217 Gr. C5 but has a lower carbon content and has nickel additions to achieve superior working properties and equal or superior tensile properties.

Specifically, the object of this invention is to teach a low chrome casting alloy similar to ASTM A 217 Gr. C5 but having a maximum carbon content of approximately 0.06 percent and nickel additions of approximately 2.0 to 5.0 percent (nominally 3.0 percent).

DESCRIPTION OF THE PREFERRED EMBODIMENT

A comparison of the chemistry and mechanical properties of ASTM A 217 Gr C5 and the present invention referred to as Spec 409 are presented below.

| | CHEMISTRY | | | | | |
|---|---|---|---|---|---|---|
| | C | Mn | P | S | Si | Cr |
| ASTM A217-Gr C5 | .11/.15 | .40/.70 | .04x | .045x | .75x | 4.00/6.50 |
| Spec 409 | .06x | 1.0x | .04x | .04x | 1.0x | 4.75/5.75 |
| | Mo | Ni | | Cu | W | Total Trace |
| ASTM A217-Gr C5 | .45/.65 | .50x | | .050x | .10x | 1.00x |
| Spec 409 | .45/.65 | 2.75/3.50 | | — | — | — |

| | TENSILE PROPERTIES Psi | | | | |
|---|---|---|---|---|---|
| | .2YS | TS | ELONG. | RED OF AREA | BHN |
| ASTM Min A217-Gr C5 | 60,000 | 90,000 | 18 | 35 | — |
| ASTM A 217 Gr C5 Average 20 Heats | 74,000 | 97,000 | 22 | 62 | 220 |

-continued

| | TENSILE PROPERTIES Psi | | | | |
|---|---|---|---|---|---|
| | .2YS | TS | ELONG. | RED OF AREA | BHN |
| Spec 409 Average 20 Heats | 90,000 | 106,000 | 20 | 60 | 241 |

From the foregoing it is obvious that a new alloy has been developed having properties superior to the ASTM A 217 Gr C5 material. The low carbon content combined with nickel additions result in a material having a metallurgical structure known as low carbon martensite which gives the new alloy its excellent weldability and handling characteristics without preheat. The new alloy is produced in the same manner as the ASTM A 217 Gr C5 material with the exception of the low carbon content and the nickel additions.

The heat treatment to obtain the minimum properties consists of a normalize and temper. The austenization temperature for normalizing is approximately between 1750° F-1900° F and the tempering temperature between 1100°-1250° F.

In the chemistry table above an *x* following the precentage indicates a maximum percentage and the slash between percentages indicates a range. Acceptable alloys made to this invention have contained from 0.02 to 0.09 percent carbon. It is believed that an acceptable alloy to this invention could contain the following percentages of critical elements:

Carbon 0.02 to 0.09 percent, Manganese 0.4 to 1.5 percent, Nickel 2.0 to 5.0 percent, Chromium 4.0 to 7.0 percent, Molybdenum 0.3 to 1.0 percent, Silicon 0.4 to 1.5 percent, trace elements less than 1.0 percent total with the remainder essentially Iron.

We have purposely made a heat to 0.09 percent Carbon and obtained acceptable tensile properties but this approaches the Carbon level of ASTM A 217 Gr C5 (0.11/0.15 percent Carbon) and increases the hazards of cracking in handling. Our investigations have included Ni in the range of 2 to 4.3 percent and satisfactory properties were obtained, but the best composition was within the specified range of 2.75/3.25 (3 percent nominal). Chrome content between 4.0 to 5.75 was investigated. Best resuls were obtained with chrome above 4.75 percent. Presence of molybdenum is not necessary to meet minimum tensile properties but we have kept it at Spec 309 (A 217 Gr C5) levels in order not to deviate too much from the standard ASTM alloy. It is believed that Molybdenum improves high temperature tensile properties of the material.

I claim:

1. A low chrome nickel martensitic casting manufactured to the standards of ASTM A 217 Gr C5 consisting essentially of

| Ingredient | Wt. Percent |
|---|---|
| Carbon (C) | less than 0.06 |
| Manganese (Mn) | less than 1.0 |
| Phosphorus (P) | less than 0.04 |
| Sulfur (S) | less than 0.04 |
| Silicon (Si) | less than 1.0 |
| Chromium (Cr) | 4.75 to 5.75 |
| Molybdenum (Mo) | 0.45 to 0.65 |
| Nickel (Ni) | 2.75 to 3.50 |
| Iron (Fe) | essentially balance |

* * * * *